US008590519B2

(12) United States Patent
Barish

(10) Patent No.: US 8,590,519 B2
(45) Date of Patent: Nov. 26, 2013

(54) PROJECTILE LAUNCHING DEVICES PARTICULARLY USEFUL IN TOYS

(75) Inventor: Benjamin J. Barish, Tel-Aviv (IL)

(73) Assignee: Dan Barish, West Bloomfield, MI (US)

( * ) Notice: Subject to any disclaimer, the term of this patent is extended or adjusted under 35 U.S.C. 154(b) by 914 days.

(21) Appl. No.: 12/314,008

(22) Filed: Dec. 2, 2008

(65) Prior Publication Data

US 2009/0145412 A1 Jun. 11, 2009

Related U.S. Application Data

(60) Provisional application No. 60/996,791, filed on Dec. 5, 2007.

(51) Int. Cl.
*F41B 11/00* (2013.01)

(52) U.S. Cl.
USPC ..... 124/69

(58) Field of Classification Search
USPC ..... 124/69–75, 63, 48, 49, 82
See application file for complete search history.

(56) References Cited

U.S. PATENT DOCUMENTS

| | | | | | |
|---|---|---|---|---|---|
| 1,152,447 | A | * | 9/1915 | Sproull | 124/62 |
| 4,850,330 | A | * | 7/1989 | Nagayoshi | 124/76 |
| 5,373,832 | A | * | 12/1994 | D'Andrade | 124/69 |
| 5,373,833 | A | * | 12/1994 | D'Andrade | 124/69 |
| 5,507,271 | A | * | 4/1996 | Actor | 124/56 |
| 5,626,123 | A | * | 5/1997 | Johnson et al. | 124/69 |
| 5,701,879 | A | * | 12/1997 | Johnson et al. | 124/69 |
| 5,878,734 | A | * | 3/1999 | Johnson et al. | 124/59 |
| 6,000,386 | A | * | 12/1999 | Johnson et al. | 124/69 |
| 6,123,229 | A | * | 9/2000 | Barish | 222/79 |
| 6,220,237 | B1 | * | 4/2001 | Johnson et al. | 124/73 |

* cited by examiner

*Primary Examiner* — Michael Carone
*Assistant Examiner* — Reginald Tillman, Jr.

(57) ABSTRACT

A projectile launching device, comprising a housing having a barrel at one end, an air pulsator within the housing having an inlet and an outlet, a pump communicating with the inlet of the air pulsator for pumping air into the air pulsator to pressurize the air therein, a projectile chamber within the barrel for receiving a projectile to be launched, and a valve in the outlet of the air pulsator which is normally closed to permit the pump to pressurize the air therein to a desired level, the valve being openable to produce an air pulse discharge therefrom into the projectile chamber, and thereby launch the projectile from the barrel at a velocity according to the force applied to the projectile by the air pulse discharge.

12 Claims, 6 Drawing Sheets

PROJECTILE LAUNCHING DEVICES PARTICULARLY USEFUL IN TOYS

RELATED APPLICATION

This application claims the benefit of U.S. Provisional Patent Application No. 60/996,791 filed on Dec. 5, 2007, the contents of which are incorporated by reference as if fully set forth herein.

FIELD AND BACKGROUND OF THE INVENTION

The present invention relates to projectile launching devices for launching various types of projectiles. The invention is particularly useful in toys for launching soft or hollow balls, suction or magnetic darts, and the like, and the invention is therefore described below with respect to such applications, but it will be appreciated that the invention could also be used in other applications such as BB guns and other toy or non-toy weapons.

Various types of toy weapons have been developed for children for launching soft or hollow balls, suction or magnetic darts, and the like. Most of the known toys of this type utilize a spring-actuated hammer or impact device for physically impacting the projectile. However, projectiles which are subjected to repeated impact blows have a relatively short useful life, and therefore must be frequently replaced. This is particularly true where substantially large impacts are applied to the projectile in order to launch them at a relatively high velocity. In addition, the known devices do not readily permit the force applied to the projectile to be preset, and thereby the range or velocity of the projectiles to be varied. Further, such impact-type devices are relatively costly to produce, particularly when designed for applying high impact, and therefore not susceptible to low-cost volume production.

OBJECTS AND BRIEF SUMMARY OF THE PRESENT INVENTION

An object of the present invention is to provide a projectile launching device having advantages in one or more of the above respects. Another object of the invention is to provide a projectile launching device particularly useful in toys.

According to one broad aspect of the present invention, there is provided a projectile launching device, comprising: a housing having a barrel at one end; an air pulsator within the housing having an inlet and an outlet; a pump communicating with the inlet of the air pulsator for pumping air into the air pulsator to pressurize the air therein; and a projectile chamber within the barrel for receiving a projectile to be launched. The air pulsator includes a pressure-responsive valve which is normally closed to permit the pump to pressurize the air therein to a desired level, but is automatically openable in response to a maximum high-pressure within the pulsator to output an air pulse discharge therefrom into the projectile chamber, and thereby to launch the projectile from the barrel at a velocity according to the force applied to the projectile by the air pulse discharge.

As will be described more particularly below, such a projectile launching device launches the projectile by a pulse or blast of air, rather than by a physical impact, and thereby enables the projectile to be reused many times. Moreover, the force of the air blast can be conveniently preset which thereby enables the velocity and/or range of the projectile launched from the device to be easily preset as desired.

According to further features in the described preferred embodiments, the pump is a manually-driven or hand-driven pump, and the housing is a portable unit constructed as a hand-held toy, such as a toy gun for shooting light soft balls, hollow balls, suction darts, and the like.

According to another aspect of the invention, the device is formed with a first opening in the barrel for introducing the projectile into the projectile chamber. It further includes a slidable feeder sleeve received on the barrel and slidable axially thereof, said slidable feeder sleeve being formed with a second opening alignable with the first opening in one position of the slidable feeder sleeve to permit introducing a projectile into the projectile chamber, and disalignable with respect to the first opening to close same to permit launching the projectile from the barrel when an air pulse discharge is applied to the projectile by the opening of the valve. In the described preferred embodiments, the slidable feeder sleeve is received within the end of the barrel and includes a knob projecting outwardly from the end of the barrel. The knob is manually graspable by a user to slide the feeder sleeve in one direction to align, or in the opposite direction to disalign, the second opening in the inner sleeve with respect to the first opening in the barrel.

As will be described more particularly below, such a construction permits repeatedly shooting a plurality of soft balls, hollow balls, or the like held in a holder.

A further embodiment is described wherein the end of the barrel serves as the projectile chamber and is designed to receive a suction dart, having a stem at one end, a suction cup at the opposite end to project externally of the barrel, and a plurality of fins between the stem and suction cup to be received over the outer surface of the end of the barrel.

Further features and advantages of the invention will be apparent from the description below.

BRIEF DESCRIPTION OF THE DRAWINGS

The invention is herein described, by way of example only, with reference to the accompanying drawings, wherein.

It is to be understood that the foregoing drawings, and the description below, are provided primarily for purposes of facilitating understanding the conceptual aspects of the invention and possible embodiments thereof, including what is presently considered to be a preferred embodiment. In the interest of clarity and brevity, no attempt is made to provide more details than necessary to enable one skilled in the art, using routine skill and design, to understand and practice the described invention. It is to be further understood that the embodiments described are for purposes of example only, and that the invention is capable of being embodied in other forms and applications than described herein.

DESCRIPTION OF PREFERRED EMBODIMENTS

Figure 4:
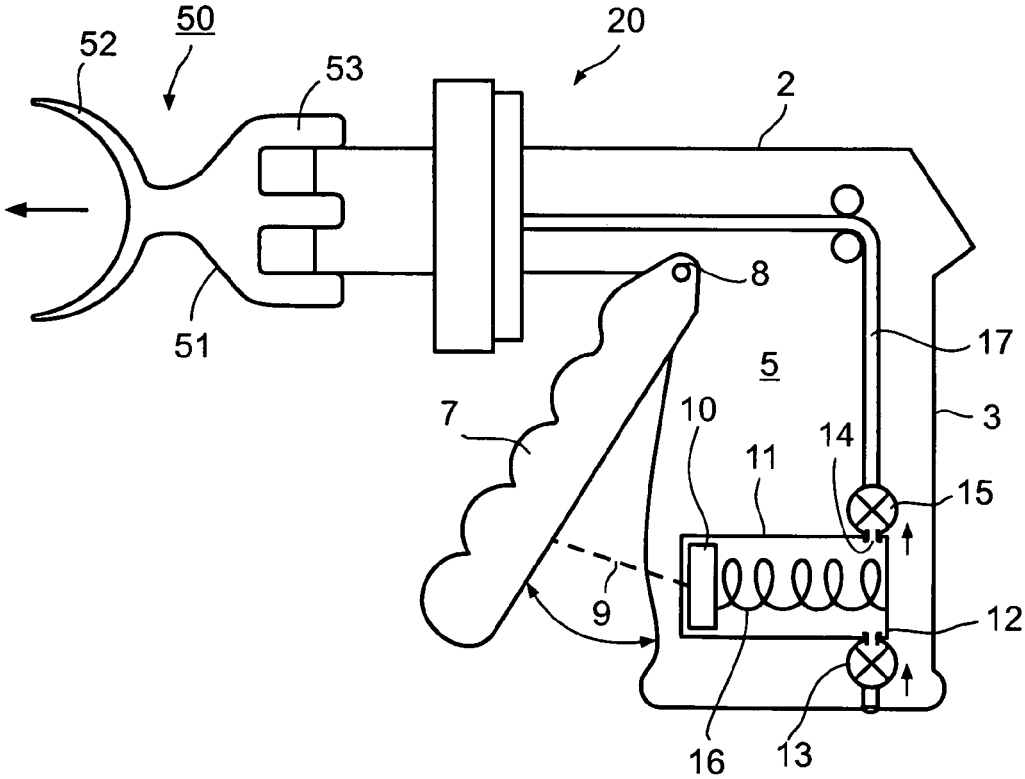
FIG. 4 is a diagrammatic side-elevational view illustrating another embodiment of the invention in the form of a toy gun for launching suction darts.
Figure 5:
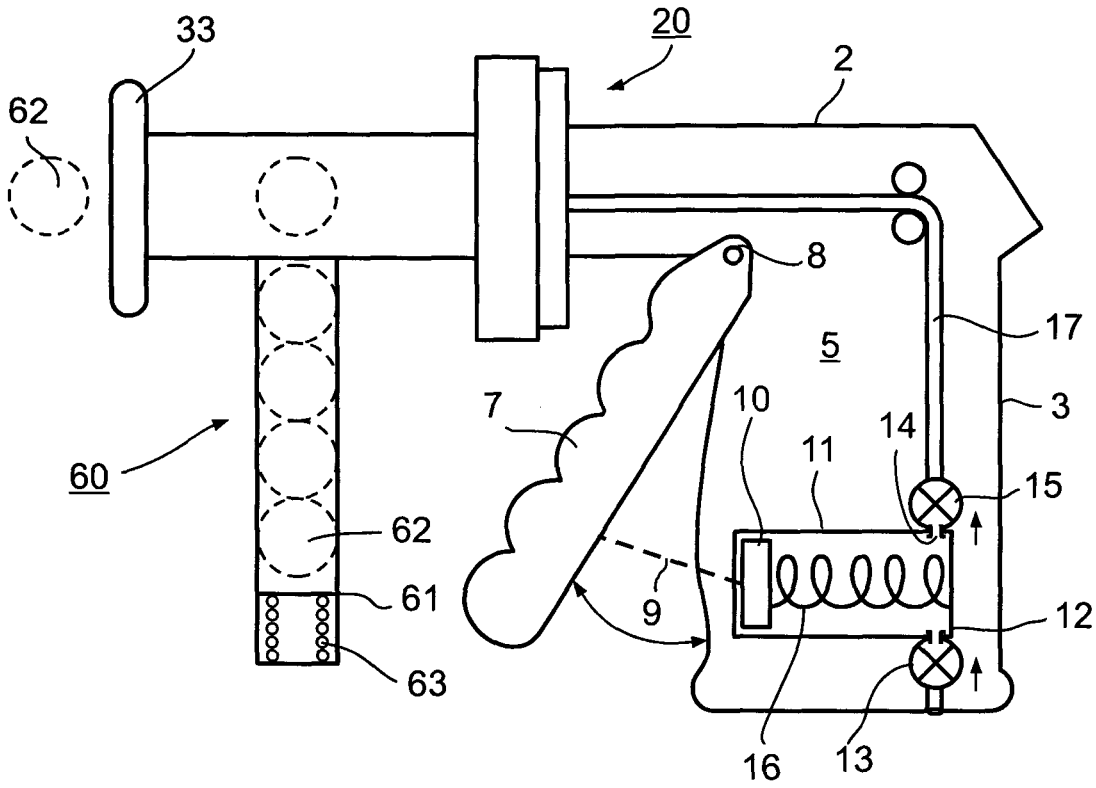
FIGS. 5 and 6 illustrate toy guns of similar structure as FIGS. 1-3*e* but for launching hollow plastic balls.
Figure 6:
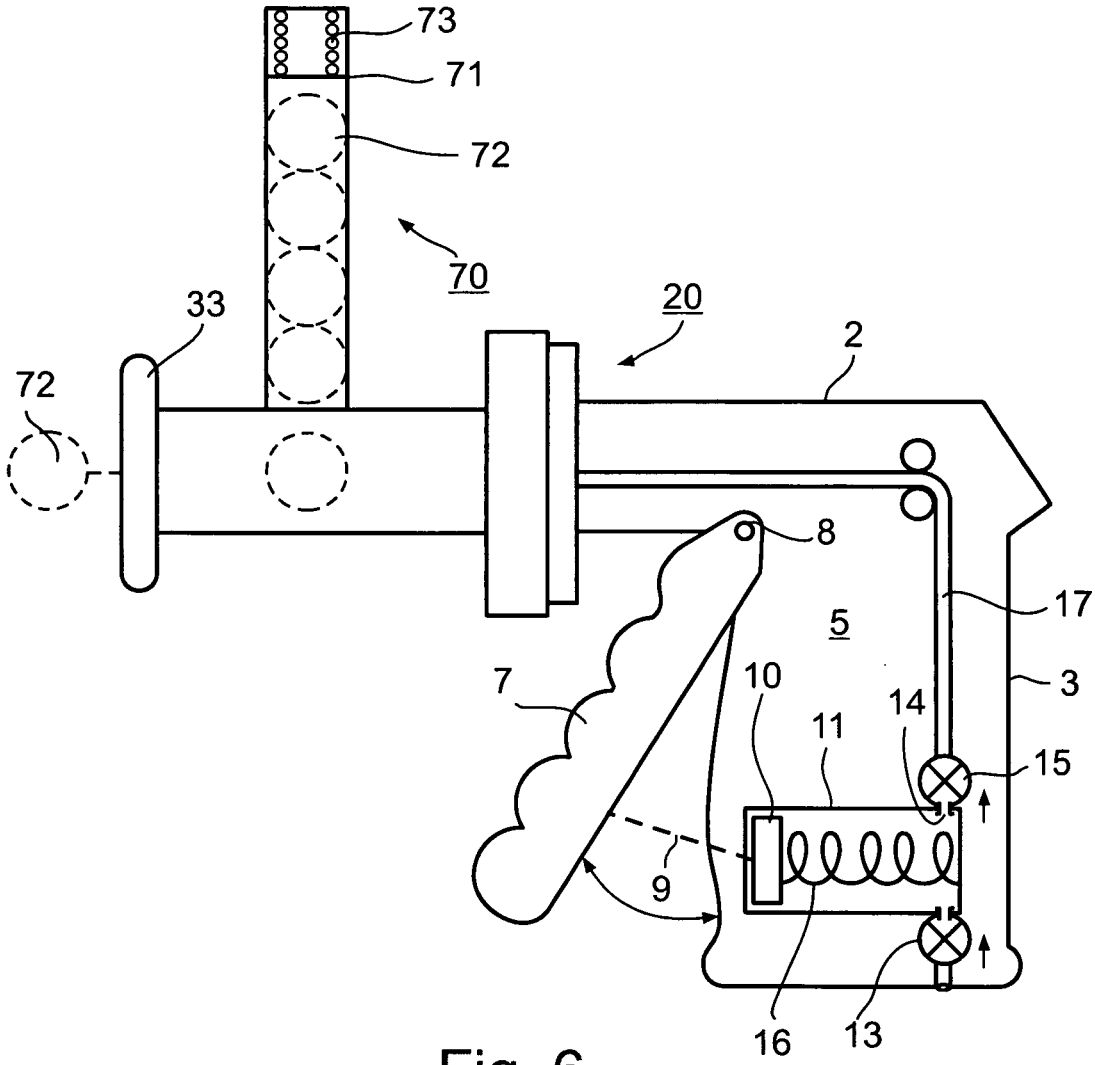

The preferred embodiments of the invention described below relate to a projectile launching device constructed as a toy weapon. FIGS. 1-3*e* illustrate the device in the form of a toy gun or pistol for launching light-weight, soft, spongy balls; FIG. 4 illustrates the device in the form of a toy gun for launching suction darts; and FIGS. 5 and 6 illustrate devices in the form of toy guns for launching hollow plastic balls.

The Embodiment of FIGS. 1-3*e*

The projectile launching device illustrated in FIGS. 1-3*e* is a toy gun including a housing 2 formed with a handle 3 at one end for grasping by the user, and a barrel 4 at the opposite end through which projectiles are to be launched. In this case, the projectiles are soft, light-weight, spherical balls 5, e.g., made of a spongy plastic material, held in a funnel-shaped holder 6 mounted at the end of barrel 4.

Figure 1:
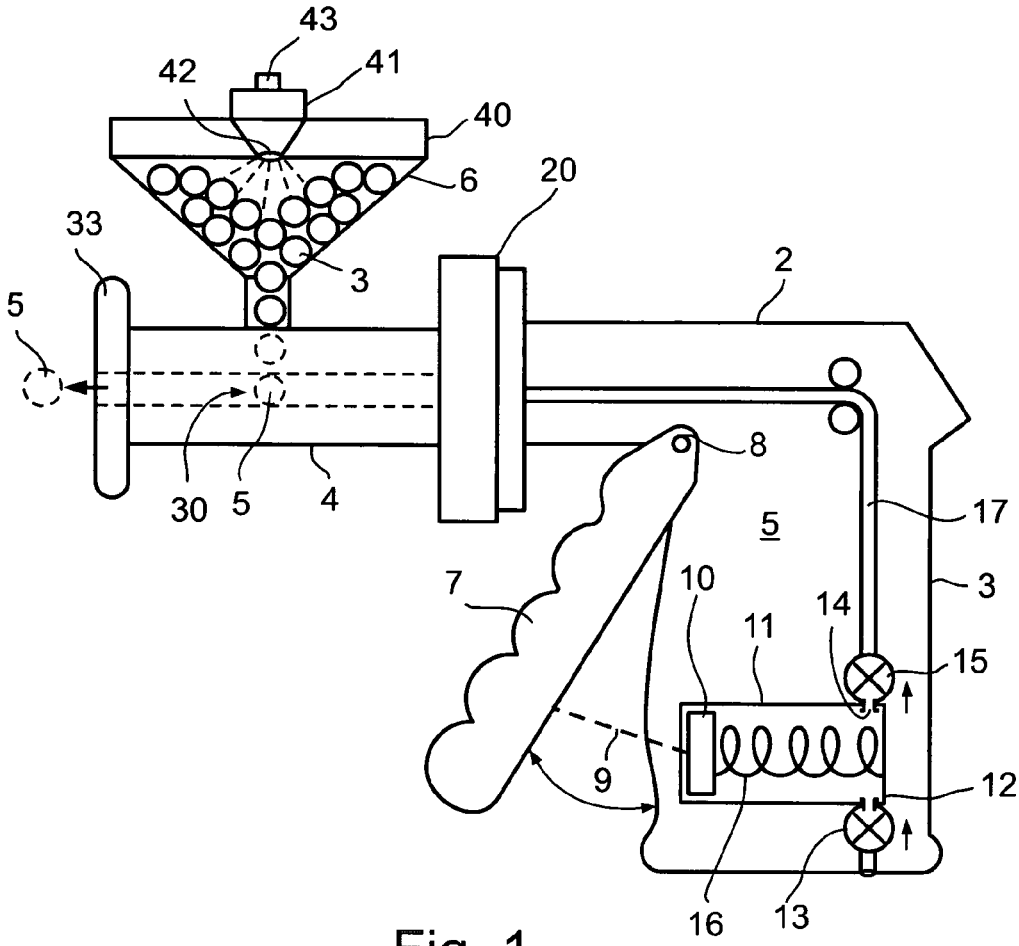
FIG. 1 is a diagrammatic side-evational view of a projectile launching device constructed in accordance with the present invention in the form of a toy gun for launching soft, spongy balls.
Figure 2:
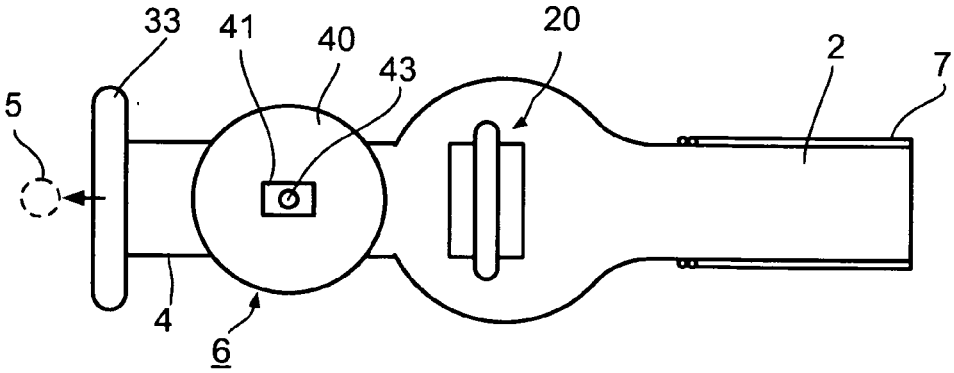
FIG. 2 is a diagrammatic top view of the toy gun of FIG. 1.

As further shown in FIG. 1, the toy pistol further includes an actuator for launching the projectiles. The actuator includes a hand-operated pump for manually pumping ambient air through the discharge end of barrel 4, by means of a lever 7 pivotally mounted at its upper end 8 to housing 2, and coupled at its lower end, by a coupling shown schematically at 9, to a piston 10 movable within a cylinder 11 located within handle 3.

Cylinder 11 includes an inlet port 12 connected, via a one-way valve 13, to the atmosphere. Valve 13 permits the air flow from the atmosphere into the cylinder, and not vice versa.

Cylinder 11 further includes an outlet port 14 connected by another one-way valve 15 permitting only the outflow of air from cylinder 11 upon the displacement of piston 10 within the cylinder. A spring 16 within cylinder 11 urges piston 10 to its normal position illustrated in FIG. 1, permitting the entry of air from the atmosphere into the cylinder via one-way valve 13. When lever 7 is pivoted towards handle 3, piston 10 is moved towards the opposite end of the cylinder, to thereby force the air therefrom out through one-way valve 15 into an outlet conduit 17 leading to an air pulsator 20, in which air pressure is built up and then suddenly released as a pulse or blast for launching a projectile 5 from projectile chamber, generally designated 30, at a high velocity through the end of barrel 4.

Figure 3A:
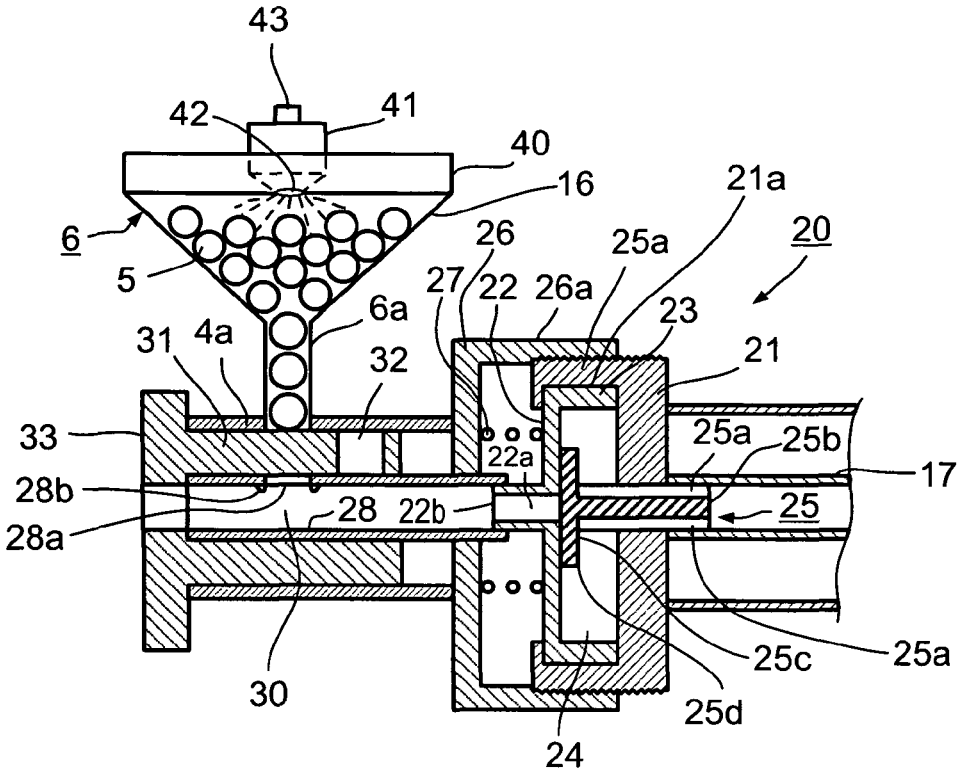
FIGS. 3*a*-3*e* are diagrammatic fragmentary views illustrating various stages in the use of the toy gun of FIG. 1.

The structures of air pulsator 20 and projectile chamber 30 are more particularly illustrated in FIG. 3*a*.

Thus, as shown in FIG. 3*a*, air pulsator 20 includes a pair of plates 21, 22 spaced from each other by a spacer 23 to define an expansible air chamber 24 between them. Conduit 17 (FIG. 1) leading from cylinder 11 of the manual pump operated by lever 7, communicates with the interior of expansible chamber 24 via one or more axial passageways 25*a* formed through one end of a stem 25*b* of a valve 25, which stem passes through an opening in plate 21. The opposite end of valve 25 includes a valve member 25*c* normally closing an opening 22*a* formed in the second plate 22, but movable away therefrom, by a snap-action as will be described more particularly below, upon the build-up of the pressure within expansible chamber 24 to a desired level, sufficient to launch projectile 5 in projectile chamber 30 at a high velocity through the outer end of barrel 4.

For producing a snap-action opening of valve 25, valve member 25*c* within chamber 24 is formed with a deformable annular peripheral portion 25*d* which deforms during the initial deformation of plate 22 to keep opening 22*a* closed, until a predetermined pressure has been built up within chamber 24. When this occurs, peripheral portion 25*d* of valve member 25 separates from plate 22 with a snap-action to produce a high-pressure pulse discharge from chamber 24 via opening 22*a* through the projectile chamber 30 and thereby launches a projectile 5 therein at a high velocity through the open end of barrel 4.

The pressure in chamber 24, which produces a snap-action opening of valve 25 with respect to plate 22, is presettable by a collar 26 and a spring 27 interposed between the collar and plate 22. For this purpose, collar 26 is formed with an annular extension 26*a* threadedly received over an annular extension 21*a* of plate 21. Thus, threading collar 26 in one direction with respect to plate 21 contracts spring 27 to thereby increase the force applied by the spring to plate 22 resisting its movement away from plate 21, and thereby increasing the pressure within chamber 24 required for opening the valve member 25 with a snap-action. On the other hand, threading the collar in the opposite direction decreases the force applied by spring 27, and thereby decreases the required opening pressure of valve 25.

As seen in FIG. 3*a*, valve opening 22*a* in plate 22 is circumscribed, on its outlet side, by a hollow stem 22*b* which is telescopically received within the end of a conduit 28 fixed to housing 2 in alignment with conduit 17 and passing through a central opening formed in collar 26. The arrangement is such that, when valve 25 is opened, the pressurized air within chamber 24 is applied as a pulse discharge to the projectile chamber 30 within the interior of conduit 28.

Projectile chamber 30 is near the end of barrel 4. An opening 28*a* is formed in the inner conduit 28. Another opening 4*a* is formed in the outer end of barrel 4 in alignment with opening 28*a*. Opening 28*a* may be circumscribed by an annular rib 28*b* projecting slightly into chamber 30 to releasably retain a ball 5 therein.

The lower end of funnel-shaped holder 6 is formed with a tubular extension 6*a* received within opening 4*a* of the barrel for feeding the projectiles 5 one-by-one, to opening 4*a*. Projectiles 5, however, are normally blocked from dropping into the projectile chamber 30 via opening 28*a* by a feeder sleeve 31 slidable in the annular space between conduit 28 and the outer end of barrel 4. Sleeve 31 is formed, at its inner end, with an opening 32 dimensioned to freely receive one of the projectiles 5. Sleeve 31 is further formed with an outer knob 33 at its outer end graspable by the user for sliding sleeve 31 either to its inner position illustrated in FIG. 3*a* or to its outer position illustrated in FIG. 3*b*. In its inner position (FIG. 3*a*), its opening 32 is out of alignment with openings 4*a* and 28*a;* and in its outer position (FIG. 3*b*), its opening 32 is aligned with the two openings 4*a* and 28*a*, thereby permitting a projectile 5 to freely drop into the projectile chamber 30 at the end of the barrel.

Operation

The operation of the illustrated device will now be described particularly with reference to FIGS. 3*a*-3*e*.

FIG. 3*a* diagrammatically illustrates the initial condition of the device, wherein feeder sleeve 31 is in its innermost position so that its projectile-receiving opening 32 is non-aligned with openings 4*a* and 28*a* in barrel 4 and the inner conduit 28, respectively. In this initial condition of the device, there is no projectile 5 in projectile chamber 30 at the outer end of the barrel.

Figure 3B:
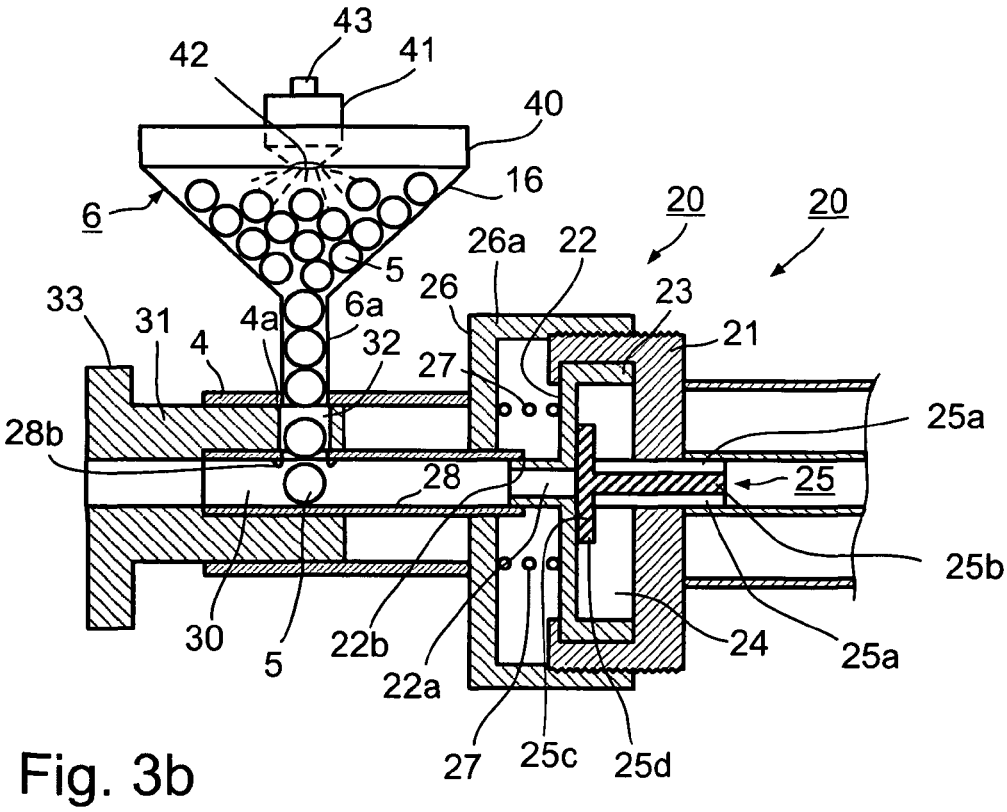
Figure 3C:
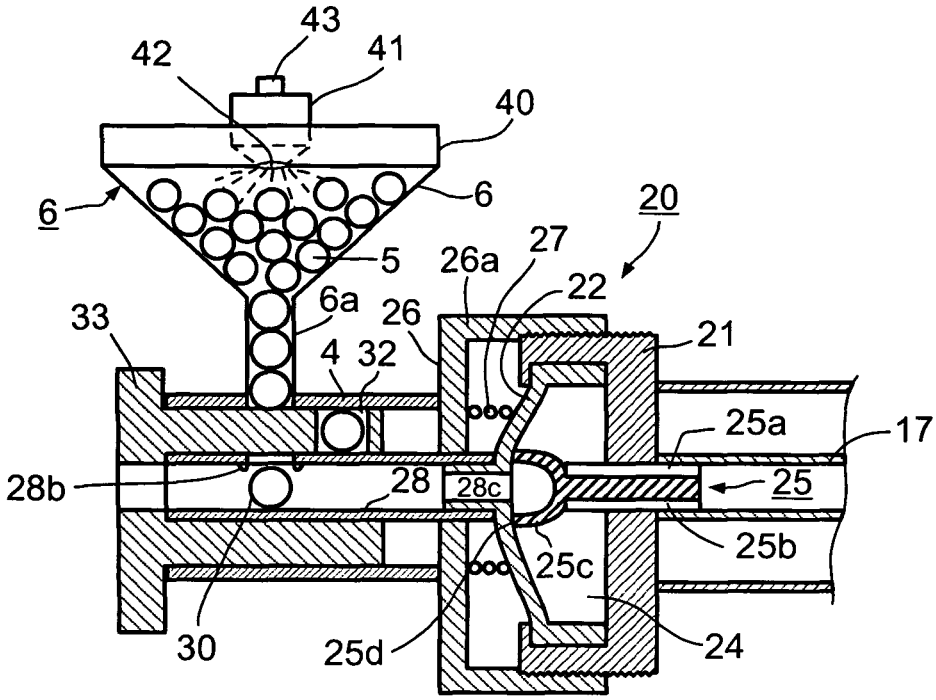

In order to load a projectile into projectile chamber 30, feeder sleeve 31 is moved first outwardly to the position illustrated in FIG. 3*b*, and then inwardly back to its inner position as illustrated in FIG. 3*c*. As shown in FIG. 3*b*, when sleeve 31 is moved outwardly, it aligns its opening 32 with openings 4*a* and 28*a* in barrel 4 and inner conduit 28, respectively, to thereby permit the lowest projectile 5 in funnel holder 6 to drop through all three openings into projectile chamber 30. At the same time, the next-lower projectile 5 in holder 6 is received within opening 32 of sleeve 31.

When sleeve 31 is moved back to its inner position (FIG. 3*c*), besides receiving another projectile 5 within its opening 32, it also closes opening 28*a* of the projectile chamber 30 within the inner conduit 28. Thus, as shown in FIG. 3*c*, the device is now loaded with a single projectile 5 within projectile chamber 30 and retained by annular rib 31. The device is also loaded with another projectile 5 received within opening 32 of sleeve 31. The latter projectile 5 is thus in position for being fed to projectile station 30 during the next outward and inward movement of the feeding sleeve 31.

The device may then be fired by operating lever 7 to launch the projectile 5 within projectile chamber 30 through the open end of barrel 4. This operation is more particularly illustrated in FIGS. 3*c*-3*e*.

Figure 3D:
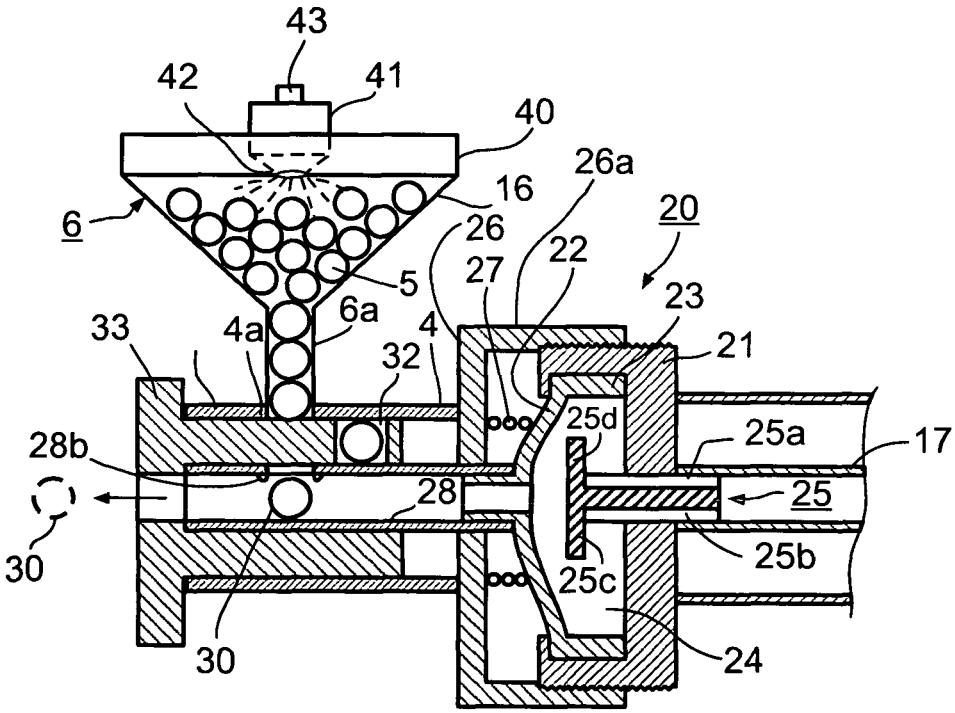
Figure 3E:
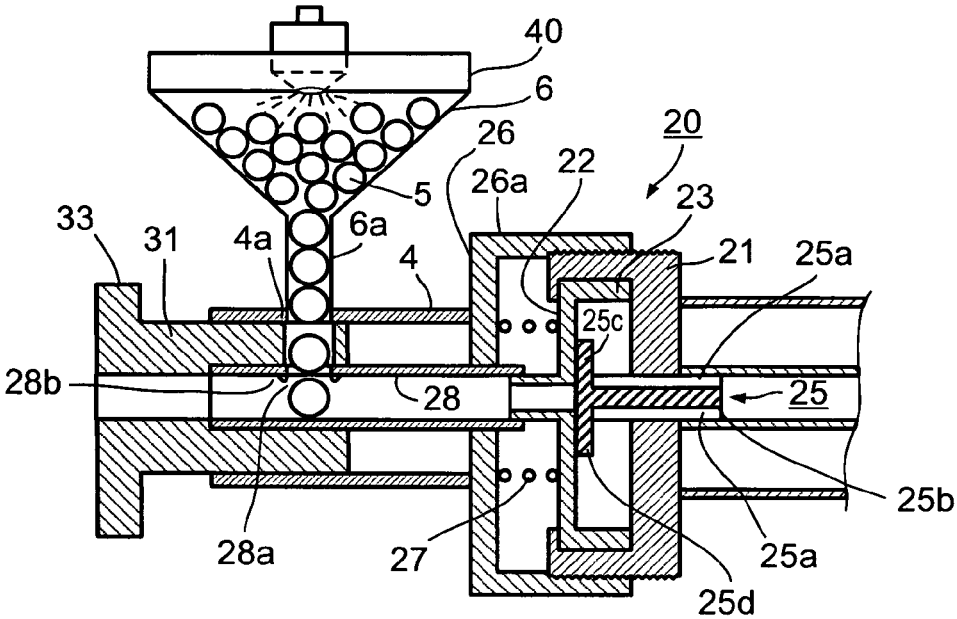

Thus, as shown in FIG. 3*c*, when lever 7 is moved inwardly with respect to handle 3, the air within cylinder 3 is pumped, via conduit 17, into chamber 24 of the air pulsator 20 via passageway(s) 25*a* in valve number 25. As indicated above, valve number 25 normally closes the outlet opening 22*a* in plate 22 from chamber 24, thereby causing the built-up pressure to deform or bow plate 22, as shown in FIG. 3*c*. During the initial deformation of the plate, the peripheral portion 25*d* of valve member 25*c* also deforms to retain closed the valve member 25*c* within opening 22*a*. However, at a predetermined level in chamber 24, the deformation of plate 22 exceeds the capability of valve member 25*c* to retain the valve opening closed, thereby causing the valve to unseat from valve opening 22*a*. This causes valve member 25*c* to open with a snap-action, as shown in FIG. 3*d*. This produces a highly pressurized air pulse discharge from chamber 24, which passes via conduit 28 to the projectile chamber 30, and thereby launches the projectile therein at a high velocity from the outer end of barrel 4.

After a projectile has thus been launched from the device, feeding sleeve 31 may again be moved outwardly (FIG. 3*e*) and then inwardly (FIG. 3*c*) to feed another projectile into projectile station 30 in position for being launched during the next operation of the device by lever 9.

It will thus be seen that, in order to load another projectile into the projectile chamber 30, it is only necessary to move feeder sleeve 31 to its outer position illustration in FIG. 3*b*, and then inwardly to its inner position illustrated in FIG. 3*c*, whereupon a new projectile is in the projectile chamber for launching by actuation of trigger 7.

For safety purposes, the projectiles 5 are preferably in the form of spherical balls of soft, light-weight, spongy cellular material, such as "NERF" material, and are of spherical configuration to facilitate feeding them to the projectile chamber from the funnel holder 6, as described above.

As shown in FIGS. 1-3*e*, the holder 6 may be provided with means for wetting the balls 5. This may conveniently be done by providing funnel holder 6 with a cover 40 holding a small reservoir 41 of the wetting liquid, such as water, which is sprayed from a nozzle 42 into the interior of the funnel. This may be done by depressing finger-piece 43 a sufficient number of times according to the degree of wetting desired. In most cases, the wetting liquid would be plain water, but may also include a washable dye if desired to serve as a marker of the point impacted by the discharged ball.

The described device thus launches the projectiles, not with a physical impact, but rather with an air blast or air pulse, whose magnitude can be preset according to a desired projectile launching velocity. Since the air blast is produced by an air cylinder type of force-multiplier, namely the air pulsator 20, the force multiplication can be predesigned as desired by suitably dimensioning the air passageways from piston-cylinder 10, 11, to the projectile chamber 30. The force multiplication can also be increased by moving linkage 9 to piston cylinder 10, 11 closer to the pivotable axis 8 of the lever 7. Although this increases the force produced by operating the lever, it also decreases the air displacement by each such operation; but since valve 15 is a one-way valve, the lever may be operated several times to pressurize chamber 28 sufficiently to snap-open valve 25 and thereby to produce the desired air pulse force to launch the projectiles. Thus, virtually the only limit on the magnitude of the air blast produced, and thereby of the velocity or range of the projectile launched, is the physical strength of the operator and of the parts used.

Many variations can be made. For example, the device could be fed with balls or other projectiles by manually inserting them one-by-one into the projectile station 30 via opening 4*a*. The balls could also be other than spherical shape, e.g., of bullet shape. As described with respect to FIGS. 5 and 6 below, the balls, could be hollow plastic balls (e.g., like small ping-pong balls). Also, the illustrated launching device could be used with other types of projectiles, such as BB-balls, and other types of manual actuators or pumps, such as manually-graspable knobs which are mounted for longitudinal movement, or pivotal movement, on the barrel. Further, instead of manually feeding the projectiles 5 to the projectile station 30, by manually operating feeder sleeve 31, the feeder sleeve could be mechanically coupled to lever 7, or other actuator means, to cause the lever also to concurrently actuate the feeder sleeve with a forward and return movement during each operation of the lever, in the manner described above.

The Embodiment of FIG. 4

FIG. 4 illustrates the invention embodied in a toy gun for launching suction darts or the like, instead of spherical balls.

In this embodiment of the invention, the toy gun is constructed as described above with respect to FIGS. 1-3*e*, except that instead of feeding balls 5 to the projectile station 30, the projectile station is designed to receive a suction dart, generally designated 50. A stem 51 at one end of the dart is received within the open end of the barrel 4; a suction cup 52 at the opposite end of the dart projects outwardly of the barrel; and a plurality of guiding fins 53 between the stem and the suction cup of the dart are received over the outer end of the barrel. Accordingly, when a blast of air is applied to stem 51 of the suction dart within the projectile chamber 30 by the operation of the device as described above with respect to FIGS. 1-3*e*, the suction dart is launched outwardly of the barrel at high velocity.

The toy gun illustrated in FIG. 4 may otherwise be constructed as described above with respect to FIGS. 1-3*e*, and therefore the corresponding parts of the toy gun are identified by the same references numerals as in FIGS. 1-3*e*.

FIG. 4 illustrates the toy gun designed for launching a single suction dart during each operation, but it will be appreciated that the toy gun could be supplied with a turret or other magazine type holder for holding a plurality of such suction darts before manual reloading is required, e.g., as described in U.S. Pat. No. 5,553,598, or that it could be designed for launching magnetic darts, etc.

The Embodiments of FIGS. 5 and 6

FIGS. 5 and 6 illustrate toy guns similar to the construction of FIGS. 1-3*e*, but wherein the toy gun discharges hollow plastic balls, instead of soft spongy rubber balls. In both constructions, the hollow plastic balls are included in a holder for holding a plurality of them and for feeding them one-by-one to the projectile chamber in the barrel. In addition, the holders are of a cylindrical construction attachable at one end to the barrel, and include a spring at the opposite end for feeding the balls one-by-one to the projectile chamber.

In FIG. 5, the holder is generally designated 60, it is attachable at its upper end to the underside of barrel 2, and includes a plate 61 at its lower end engageable with the lowermost ball 62 and urged by a spring 63 to feed the balls one-by-one into the projectile station in barrel 2. In the structure of FIG. 6, the holder 70 is attachable at its lower end to the upper side of the barrel 2, and includes at its upper end a plate 71 engageable with the uppermost ball 72 and urged by a spring 73 to feed the balls one-by-one into the projectile chamber of barrel 2.

It will be seen that the barrel 4, and the feeder 33, in both constructions are as described above with respect to FIGS. 1-3*c*, except that their dimensions, as well as of the openings through which the balls are fed into the projectile chamber, would be determined according to the dimensions of the hollow balls. In FIG. 5, the holder 60 for the balls is on the underside of the barrel 4. A similar construction of feeder sleeve 33 and barrel 4 would be provided for FIG. 6, except that the access openings would be from the underside of the barrel, rather than from the upper side. In all other respects, the construction of the toy gun illustrated in FIGS. 5 and 6 is the same as described above with respect to FIGS. 1-3*c*, and therefore the same reference numerals have been used to identify corresponding parts to facilitate understanding.

It is to be appreciated that the invention has been described above with respect to several preferred embodiments for purposes of example only, and that many other variations, modifications and applications of the invention may be made.

What is claimed is:

1. A projectile launching device, comprising:
a housing having a barrel at one end;
a projectile chamber within the barrel for receiving a projectile to be launched;
an actuator for launching the projectile through the barrel;
the barrel being formed with a first opening for introducing the projectile into the projectile chamber;
and a slidable feeder sleeve received on said barrel and slidable axially thereof, said slidable feeder sleeve being formed with a second opening alignable with said first opening in one position of the slidable feeder sleeve to permit introducing a projectile into the projectile chamber, and disalignable with respect to said first opening to close same to permit launching the projectile from the barrel when said actuator is actuated.

2. The device according to claim 1, wherein said slidable feeder sleeve is received within the barrel and includes a knob projecting outwardly from the end of the barrel manually graspable by a user to slide the feeder sleeve to align or disalign said second opening in the feeder sleeve with respect to said first opening in the barrel.

3. The device according to claim 2, wherein the device further includes a holder for holding a plurality of projectiles for feeding them one-by-one to the projectile chamber.

4. The device according to claim 1, wherein the device further comprises:
an air pulsator within the housing having an inlet and an outlet;
a pump communicating with the inlet of the air pulsator for pumping air into the air pulsator to pressurize the air therein;
and a valve in the outlet of the air pulsator which is normally closed to permit the pump to pressurize the air in said air pulsator to a desired level, said valve being openable to produce a pulse discharge of air into the projectile chamber, and thereby to launch the projectile from the barrel at a velocity according to the force applied to the projectile by said air pulse discharge.

5. The device according to claim 4, wherein said valve is a pressure-responsive snap-action valve which automatically opens when the pressure of the air in the air pulsator has reached a predetermined pressure.

6. The device according to claim 5, wherein the device further includes a presettable member for presetting said predetermined pressure at which said valve automatically opens, and thereby the velocity of the projectile launched from the device.

7. The device according to claim 6, wherein said air pulsator includes an expansible chamber and a spring which is loaded upon the expansion of the expansible chamber.

8. The device according to claim 7, wherein said expansible chamber is defined by a pair of spaced plates, said spring urging the plates towards each other to contract the expansible chamber, but being loaded by the plates when the expansible chamber is expanded by pressurizing the air therein.

9. The device according to claim 8, wherein said spring is interposed between a collar and one of the plates, the collar being threadedly received with respect to the other of the plates to thereby enable presetting the required valve-opening force exerted by the spring.

10. The device according to claim 9, wherein said valve includes a valve member carried by one of the plates normally receivable within a valve opening in the other of the plates.

11. The device according to claim 4, wherein the pump is a manually-driven pump.

12. The device according to claim 4, wherein said housing is constructed so as to be a hand-held toy.

* * * * *